US006172658B1

(12) United States Patent
Romberg

(10) Patent No.: US 6,172,658 B1
(45) Date of Patent: Jan. 9, 2001

(54) BUBBLE IMAGING TECHNOLOGY

(75) Inventor: Frederick W. Romberg, La Canada, CA (US)

(73) Assignee: California Institute of Technology, Pasadena, CA (US)

( * ) Notice: Under 35 U.S.C. 154(b), the term of this patent shall be extended for 0 days.

(21) Appl. No.: 09/437,824

(22) Filed: Nov. 10, 1999

Related U.S. Application Data

(60) Provisional application No. 60/108,267, filed on Nov. 12, 1998.

(51) Int. Cl.[7] ..... G09G 3/00

(52) U.S. Cl. ..... 345/30; 40/406; 40/407; 40/439

(58) Field of Search ..... 40/439, 406, 407, 40/498; 345/30, 31

(56) References Cited

U.S. PATENT DOCUMENTS

| | | | | |
|---|---|---|---|---|
| 3,706,149 | * | 12/1972 | Olivieri | 40/407 |
| 3,717,945 | | 2/1973 | Taylor et al. . | |
| 3,973,340 | | 8/1976 | Khawand . | |
| 4,034,493 | | 7/1977 | Ball . | |
| 4,085,533 | * | 4/1978 | Ewald | 40/406 |
| 5,349,771 | | 9/1994 | Burnett . | |
| 5,363,577 | | 11/1994 | Fuller et al. . | |
| 5,617,657 | | 4/1997 | Kahn . | |
| 5,737,860 | | 4/1998 | Whigham et al. . | |

OTHER PUBLICATIONS

PCT.International Application No. PCT/US00/09756 for Bubble Imaging Technology, applicant California Institute of Technology.

* cited by examiner

*Primary Examiner*—Kent Chang
(74) *Attorney, Agent, or Firm*—Law Offices of K. Patrick McKay, PE, Esq.

(57) ABSTRACT

A method and apparatus for producing an image defined by fluid bubbles in a medium fluid. Alphanumeric digits and/or graphic images in a fluid medium are formed by injecting into the fluid medium a multitude of fluid bubbles having a density different than that of the medium fluid.

Using non-gaseous fluids, the fluid bubbles take on a natural shape which is not confined by any structures as it travels through the medium fluid. The rate at which the fluid bubbles rise or fall through a medium fluid is directly dependent on the viscosity of the individual fluids and the difference between the fluid viscosities. The viscosity of the medium fluid also influences the rate of formation of bubbles which are being created. The control and timing circuitry determines the time interval wherein each horizontal row of bubbles is created. The rows of bubbles then create a 2-D or 3-D image, conducive for various applications as signs or displays.

25 Claims, 9 Drawing Sheets

BUBBLE IMAGING TECHNOLOGY

SPECIFIC REFERENCE

The inventor hereby claims benefit of priority date so established for provisional application No. 60/108,267, filed Nov. 12, 1998 for Bubble Imaging Technology.

BACKGROUND OF THE INVENTION

1. Field of the Invention

The present invention relates to the method and apparatus for producing an image defined by fluid bubbles in a medium fluid. In particular, alphanumeric digits and/or graphic images in a fluid medium are formed by injecting into the fluid medium a multitude of fluid bubbles having a density different than that of the medium fluid.

2. Description of the Related Art

It is important that signs and displays which advertise a product be distinctive and unique. For instance, a corporation's image can be enhanced through the display of its corporate logo, using custom signage. Similarly, if an advertisement for a particular product is made visually unique, its sales may be increased. One way of making unique displays is the use of a liquid or gas to create an image. The image may be produced as a random shape or as a message display.

U.S. Pat. No. 4,034,493 to Ball shows how liquids of different specific gravities and selected viscosities are located in a chamber defined by two closely spaced panes or plates of a transparent material for producing a visual effect.

U.S. Pat. No. 5,349,771 to Burnett teaches a rising bubble display device including a reservoir with a lamp positioned beneath the reservoir. An air pump is mounted near the lamp, which forces bubbles up through a colored or translucent liquid, complemented by a colored light from the lamp.

U.S. Pat. No. 5,617,657 to Kahn demonstrates a multicolor liquid display system comprising a transparent conduit and system for sequentially circulating liquids of different color and different specific gravity through the conduit to present a dynamic display such as "raining" of one liquid into another.

U.S. Pat. No. 3,973,340 to Khawand shows a visual display with one or more conduits are provided in which immiscible fluids are placed for creating a predetermined visual pattern.

U.S. Pat. No. 3,717,945 teaches how liquid jets are separated into streams of individual drops to provide a three-dimensional image.

U.S. Pat. No. 5,363,577 shows a liquid display system that has a plurality of adjacent parallel tubes filled with a fluid and connected to a source of air that introduces bubbles into the I1 tubes, so that the combination of bubbles form a word, or another graphic display.

U.S. Pat. No. 5,737,860 demonstrates a device for forming a changeable sign of bubbles rising within a body of liquid or from drops of liquid moving through the air. Solenoid valves release bubbles, which are interrupted so as to produce bubbles in an array that displays a message.

In contrast with the above prior art, the present invention utilizes bubbles made from non-gaseous fluids, and allows the fluid bubbles to take on a natural shape which is not confined by any structures as it travels through the medium fluid. The rate at which the fluid bubbles rise or fall through a medium fluid is directly dependent on the viscosity ($\eta$) of the medium fluid. A more viscous medium fluid will result in the fluid bubbles rising at a slower rate. This control over the speed of travel is desirable to allow for complex images to be created, or allow for size variation in device. For example, if the device is only 13-cm tall, then it is desirable for the bubbles to rise to the surface slower than in a device that is 130-cm tall.

Since the medium and bubbles fluids become more viscous as the ambient temperature of the surroundings is decreased, the resulting viscosity will also depend upon the temperature extremes that the device will be required to function within.

The viscosity of the medium fluid also influences the rate of formation of bubbles which are being created. If a large quantity of bubbles are being created to form an image, then the medium fluid may become turbulent and make the image indistinguishable before it arrives to the surface of the medium fluid. The selection of a more viscous medium fluid produces less turbulence.

Also pertinent to design of BIT devices is the viscosity of the bubble fluid. The more viscous the fluid medium, the larger the bubble can be and still remain spherical. If the bubble is too large for a given bubble fluid, then the bubble becomes unsteady and may deform, or split into multiple bubbles. This decreases the clarity and lowers the quality of the bubble image.

Because of the dependency of both mediums on their respective viscosities, the relative viscosity between the two fluids is an important consideration when selecting the fluids. Similarly, properties such as density and specific gravity, and heat capacity play a part in the selection of fluids.

The respective fluids may also have a low freezing point to resist freezing, which may damage the internal components of the device, or crack the viewing windows. Also, the color of the fluid should not deteriorate from exposure to either sunlight or artificial light. This allows the device to provide vivid, high color images for the life of the product.

Thus, to create an apparatus which displays an aesthetically pleasing message or image, the requisite properties of the respective fluids is the most important consideration. The fluids are thereafter controlled by coupling with timing circuitry to operate an array of bubble generators, allowing for production of a colorful, long-lasting, and accurate representation of a timed message display. An example of such a product is a clock which incrementally displays the time, alphanumerically, by the release of liquid bubbles in a fluid medium.

The control and timing circuitry determines the time interval wherein the horizontal row of bubbles is created. Several horizontal rows of bubbles are created until the full vertical length of an alphanumeric digit or graphic is achieved. In one embodiment, the bubble release means includes a mechanical plunger provided for each row of bubbles. Each plunger position and timing is controlled by an electromagnet and associated control and timing electronics. Possible variations and modifications to the bubble generation include utilizing a fluid pump and over-pressure valve. The preferred method utilizes a bubble generation means that has no moving parts, using piezo devices and flow-control valves.

SUMMARY OF THE INVENTION

It is the objective of the present invention to teach a method for displaying text or images created by a fluid moving through another fluid. In conformance with that method, the objective includes the teaching of an apparatus which results in visualization of alphanumeric digits and/or graphics.

It is a further objective of the present invention to time the release of each fluid bubble or formation of fluid bubbles, created by a bubble release means, such that their size and spacing form the appearance of alphanumeric digits and/or graphics similar to the visual effects of digital clocks, messengers, display boards, and 2-D/3-D graphic displays.

It is further an objective of the present invention to coordinate the timing circuitry in conjunction with a medium fluid and a bubble fluid, having contrasting fluid qualities, thereby providing a rising or sinking image, incrementally coordinated with a time driver, like a clock.

It is further an objective of the present invention to provide a product that utilizes the method, being operable in a variety of environments with alternative power supplies. In one embodiment, a small and portable BIT product is battery powered and capable of functioning on any small horizontal surface.

Therefore, the present method and apparatuses provide a new medium for communication. This bubble imaging technology provides an aesthetically-pleasing alternative to conventional display means.

DETAILED DESCRIPTION OF THE PREFERRED EMBODIMENT

The invention will now be described in detail in relation to a preferred embodiment and implementation thereof which is exemplary in nature and descriptively specific as disclosed. As is customary, it will be understood that no limitation of the scope of the invention is thereby intended, and that the invention encompasses such alterations and further modifications in the illustrated device, and such further applications of the principles of the invention illustrated herein, as would normally occur to persons skilled in the art to which the invention relates.

Figure 1:
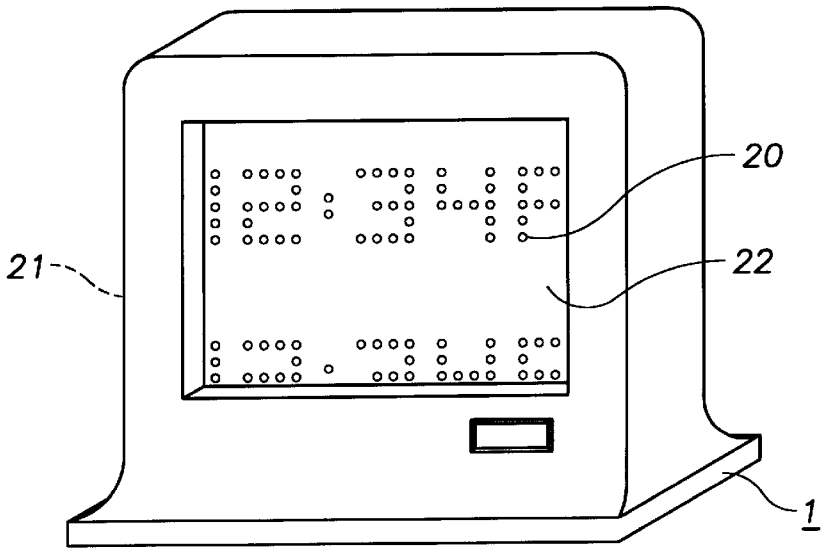
FIG. 1 is a perspective of an embodiment as a clock utilizing the present method.
Figure 2:
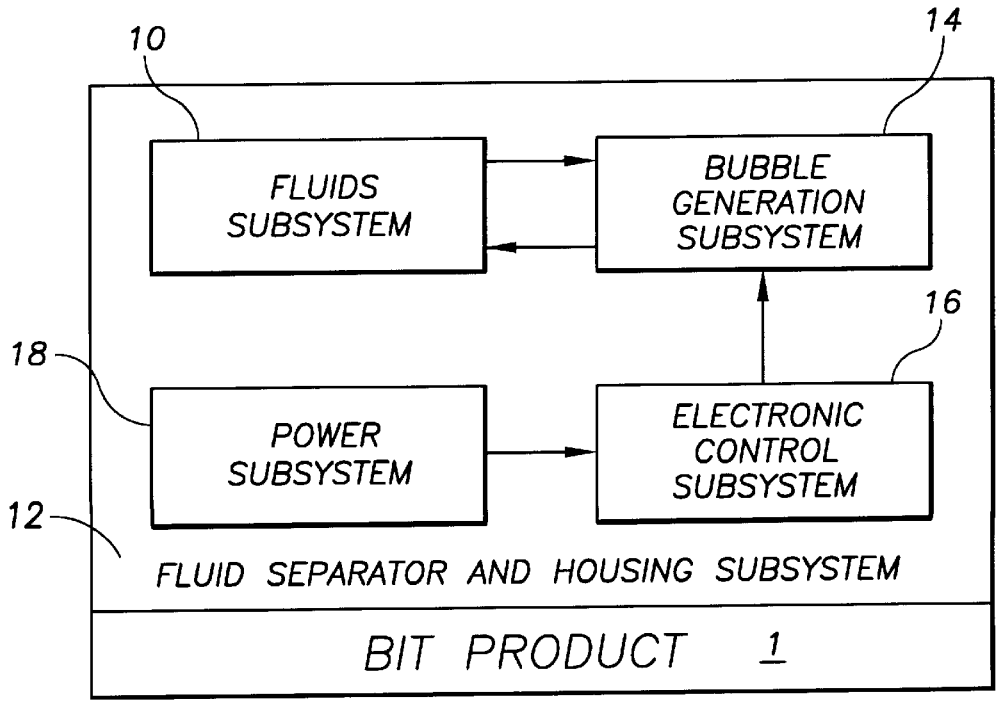
FIG. 2 is a functional block diagram showing the relation of the five main subsystems embodied within bubble imaging technology.

FIG. 1 represents a bubble image technology product (BIT) in the form of a clock. FIG. 2 describes the main internal components of the BIT product 1 represented as a block diagram utilizing the present method. A BIT product 1 is comprised of at least five subsystems. These include a fluids subsystem 10; a fluid separator and housing subsystem 12; a bubble generation subsystem 14; an electronic control subsystem 16; and a power subsystem 18.

The fluids subsystem 10 provides the desirable fluid environment wherein fluid bubbles are produced by the bubble generation subsystem 14. A BIT product 1 utilizing the present method, in this embodiment a clock, requires at least two fluids. Satisfying this requirement is a bubble fluid 21 contained within a fluid separator and housing subsystem 12 and a medium fluid 22, which differ in color such that one is visible in the other. The fluids also have different densities and viscosities such that the fluid bubbles 20 will either rise or sink within the medium fluid 22. The medium fluid 22 is either clear or colored but must remain transparent so that the bubbles are completely visible within the medium fluid 22. The bubble fluid 21 producing the fluid bubbles 20 is either clear or colored and can be either transparent, opaque or somewhere in between. The bubble fluid 21 and the medium fluid 22 are different enough in color and intensity that there is a significant contrast between them. The preferred design consists of a blue or green glow-in-the-dark bubble fluid 21 and a clear medium fluid 22.

The rate at which fluid bubbles 20 rise or sink through the medium fluid 22 is partially controlled by the medium fluid 22 viscosity. A more viscous medium fluid 22 results in the fluid bubbles 20 moving at a slower rate. This may be desirable depending upon the complexity of the image that is being created and upon the size of the overall device. For a display height of 13 cm (Bubble Clock), it is desirable for the fluid bubbles 20 to move more slowly than as compared to a device with a display height of 152 cm (Corporate Display). The required viscosity also depends upon the temperature of operation of the BIT product 1. The medium fluid 22 becomes more viscous as the ambient temperature of the surroundings is decreased. Another factor to consider when determining fluid characteristics is the number of fluid bubbles 20 being created in a given time interval. When a large number of fluid bubbles 20 are required to create an image, then the medium fluid 22 may become turbulent and make the image indistinguishable before it arrives to the surface of the medium fluid 22. To reduce the effect of this turbulence, a more viscous medium fluid 22 may be utilized.

The viscosity of the bubble fluid 21 producing the fluid bubbles 20 is also a key factor in the design of the particular product and is adjusted according to the size of the bubbles that are desired. Using a more viscous fluid allows the creation of a larger bubble that still remains spherical. If the bubbles are too large for the given bubble fluid 21 then the bubble becomes unsteady and deforms or splits into multiple bubbles. This is undesirable and lowers the clarity and quality of the bubble image formed by the fluid bubbles 20.

The rate at which fluid bubbles 20 move through the medium fluid 22 can also be controlled by varying the fluid density difference between the two fluids. A greater difference between their densities will cause the bubbles to travel faster through the medium fluid 22.

The fluids are non-toxic and pose no threat to the customer if the fluid accidentally leaks from the device or if the device is broken. The fluids are non-corrosive to prevent any damage to the internal working components of the device. The fluids do not chemically react with each other or with any of the plastic, rubber seals, or lubricants. The fluids do not deteriorate significantly over time. There is no significant breakdown in viscosity of the fluid over time. The fluids are homogenous and do not cause any buildup of residue within the device. A detergent fluid allows the bubbles to collide with one another while being more resistant to combining and forming a single large bubble. These fluid characteristics promote the creation of more complex images that require a higher number of fluid bubbles 20 per given unit of surface viewing area. Depending upon the application, the fluids also have a low freezing point so that the product will operate normal at lower temperatures and prevent damage to the product. This is important for products that may be located outdoors.

Finally, the colors of the bubble fluid 21 or medium fluid 22 do not deteriorate from exposure to either sunlight or artificial light. This assists in maintaining vivid, high color images throughout the life of the BIT product 1. Different fluids will serve better than others depending upon the particular purpose of the BIT product 1. A range of colors, sizes, and bubble image complexities are possible with these fluid characteristics.

Figure 3:
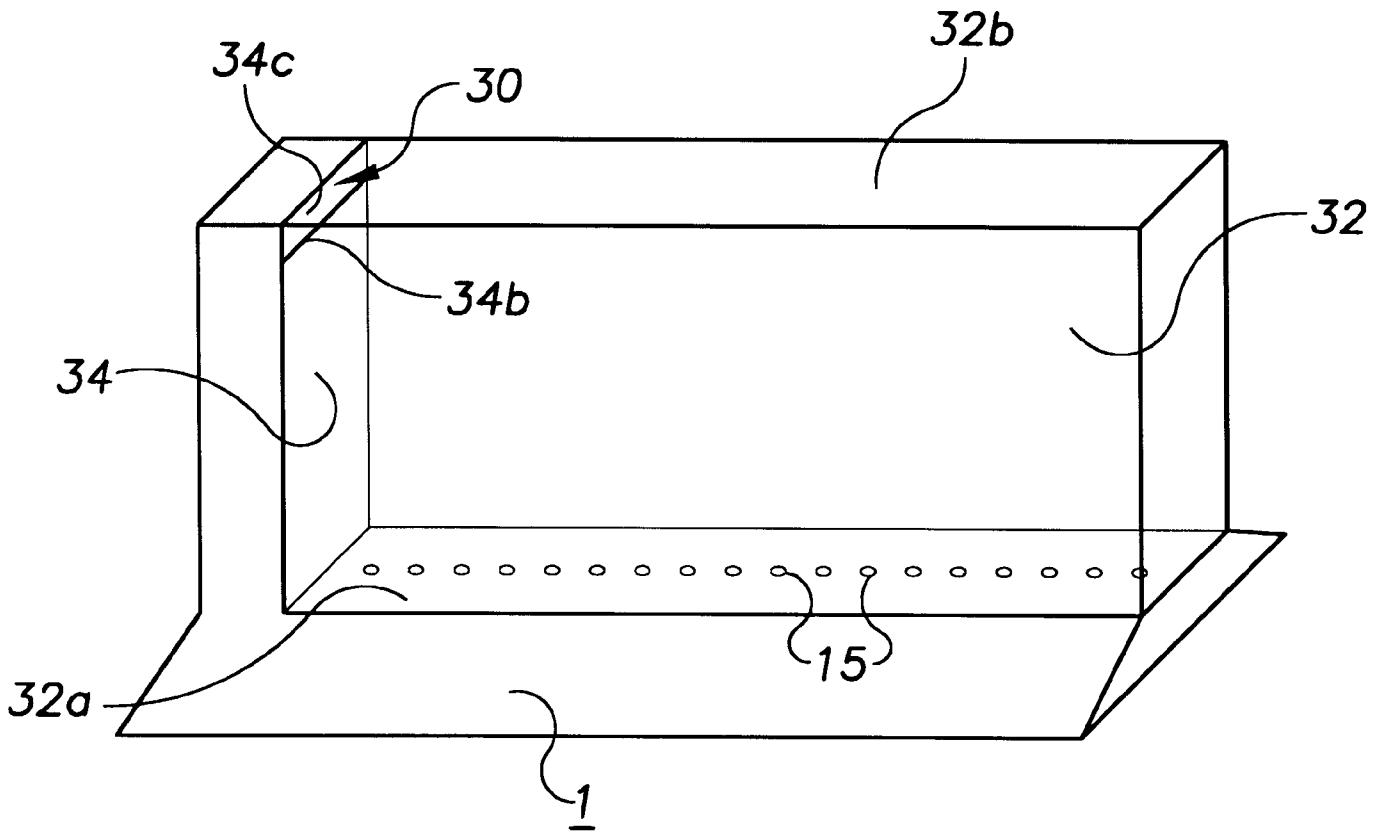
FIG. 3 is a perspective of the preferred embodiment of the assembled fluid separator and housing subsystem.

FIG. 3 is a representation of the fluid separator and housing subsystem 12 of a BIT product 1 shaped in the form of a clock, which, by no means is meant to be limiting. Examples of other exterior shapes utilizing the present method and apparatuses may include a beverage can promoting a corporate product, or any type of larger, sign-like corporate display.

The fluid separator and housing subsystem 12 is responsible for maintaining physical separation of the medium fluid from the bubble fluid. All other subsystems are attached to the fluid separator and housing subsystem 12. Although there are no moving or electrical parts in this subsystem, it has many important features and purposes. From an external view, it is a major contributor to the artistic appeal of the BIT product 1. It can take on different external shapes, sizes and colors without affecting the internal operation of the BIT product 1. The preferred color, size and shape is shown in FIG. 1 (Bubble Clock). Internally, this subsystem acts as a physical support structure for mounting of the bubble generation subsystem 14, electronic control subsystem 16, fluids subsystem 10, and power subsystem 18 (FIG. 2).

An important internal feature of the fluid separator and housing subsystem 12 is the incorporation of at least two fluid separation chambers, here a bubble fluid chamber 30 and a medium fluid chamber 32. The medium fluid chamber 32 is preferably clear, while the remaining, exterior bubble fluid chamber 30 of the BIT product 1 is a solid color. The preferred configuration (Bubble Clock) separates the medium fluid from the bubble fluid by a separation wall 34 that extends from the bottom 32*a* of the medium fluid chamber 32 up to just below the top 32*b* of the medium fluid chamber 32 to define an entrance 34*c* into the bubble fluid chamber 30. The medium fluid volume occupies the space up to but not over the top 34*b* of the separation wall 34. The less dense bubble fluids float on top of the medium fluid and overflows into the bubble fluid chamber 30 by passing over top 34*b* of the separation wall 34 into the entrance 34*c*. The bubble fluid then travels to the bubble generation subsystem 14 (FIG. 2) where it is reused to make new fluid bubbles, as further described.

The bubble generation subsystem 14 is responsible for the physical formation of fluid bubbles within the medium fluid. Three means for generating bubbles are presented. Each method can be used to create fluid bubbles either at the top or bottom of the medium fluid. Each vertical column of fluid bubbles uses a single bubble generator 15. It should be understood that each bubble generator 15 may be inverted to allow the fluid bubbles to sink depending on the density differentials of the medium fluid and the bubble fluid.

The bubble generation subsystem 14 is comprised of Z bubble generators 15 disposed within the fluid separator and housing subsystem, where Z is a whole number and depends on the size of the BIT product display and desired resolution. For example, a clock would have a single row of Z bubble generators, whereas a three dimensional corporate display will have rows and columns of bubble generators 15. Although bubble generation at the top of the medium fluid is possible, bubble generation at the bottom 32*a* of the medium fluid chamber 32 is the preferred method.

Figure 4:
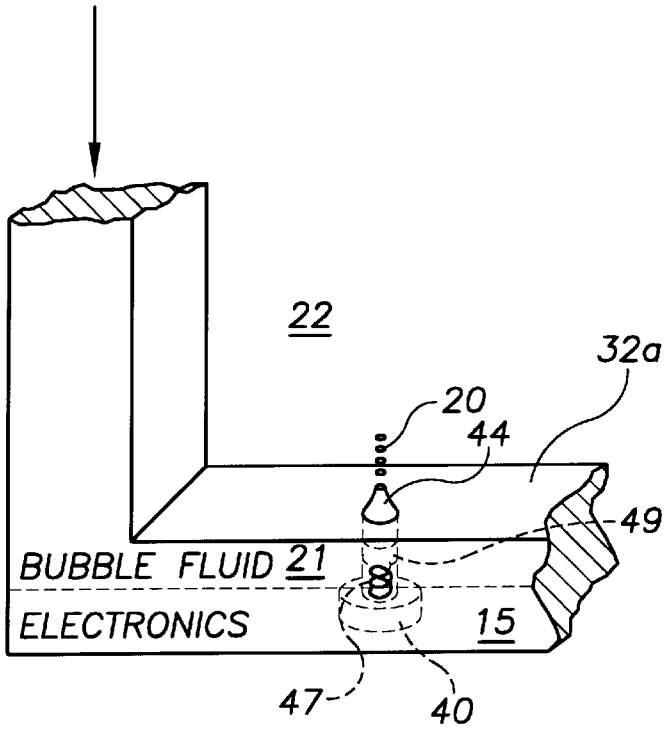
FIGS. 4 and 4*a* show a bubble generation means in the form of an electromagnet and plunger bubble generator.
Figure 4A:
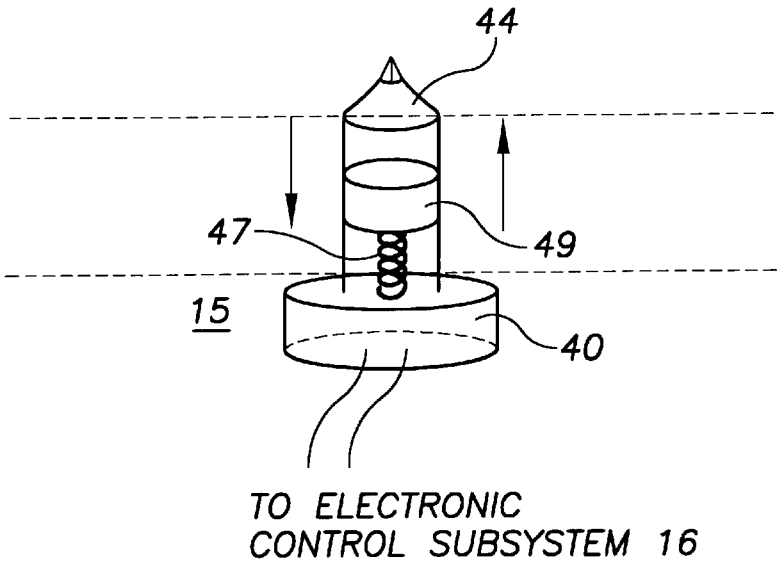

One method of bubble generation using electromagnets 40 adapted to be energized to move mechanical plungers 49 is shown in FIGS. 4 and 4*a*. This embodiment shows in detail a blow-up of a bubble generator 15, a plurality of which are disposed under the bottom 32*a* of the medium fluid chamber 32. An electromagnet 40 is energized by a connected electronic control subsystem 16, and, as a result thereof, a mechanical plunger 49 is pulled downward to compress a spring 47, which is disposed in a vertical position below the mechanical plunger 49. The electromagnet 40 is de-energized causing the plunger 49 to move back to a rest position by the force of the spring 47. This motion of the mechanical plunger 49 forces the bubble fluid 21 through a one-way valve 44 into the medium fluid 22. A fluid bubble 20 is created within the medium fluid 22 and is released. The timing of each electromagnet 40 is controlled by the electronic control subsystem 16. The size of the bubble 20 is determined by the amount of bubble fluid imparted to the medium fluid 22 by the plunger 49. Increasing the plunger 49 travel and diameter increases the size of the fluid bubble 20 created. The purpose of the valve 44 is to maintain separation of the medium fluid 22 from the bubble fluid when the production of fluid bubbles 20 is not intended and pass bubble fluid 21 to the medium fluid 22 when desired.

Figure 5:
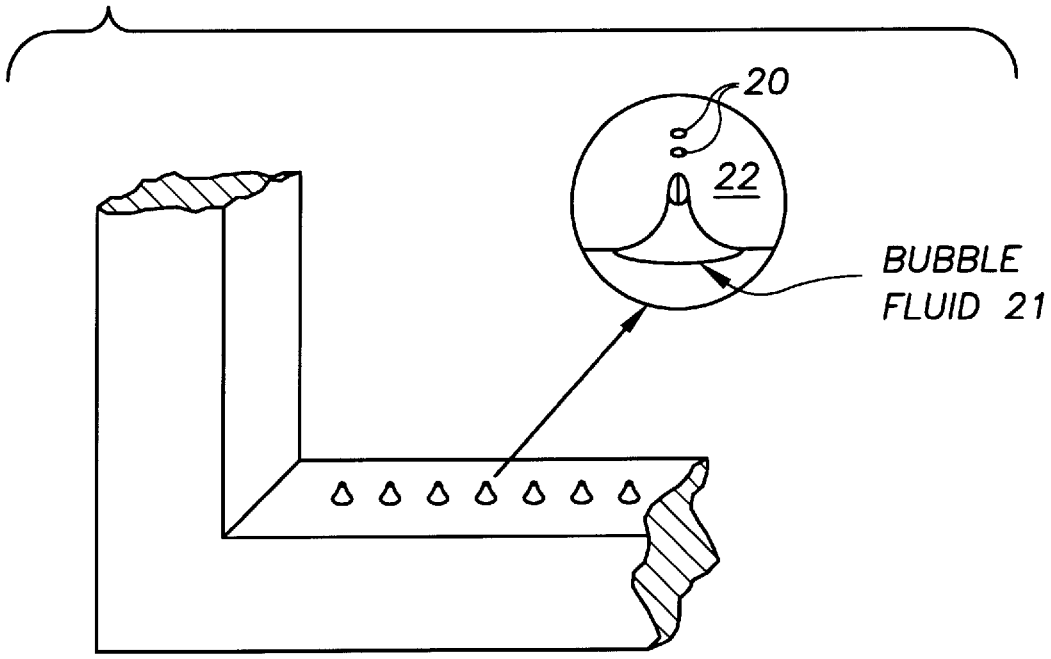
FIG. 5 shows a blow-up of a one-way flap valve that may be utilized by the bubble generation subsystem.
Figure 5A:
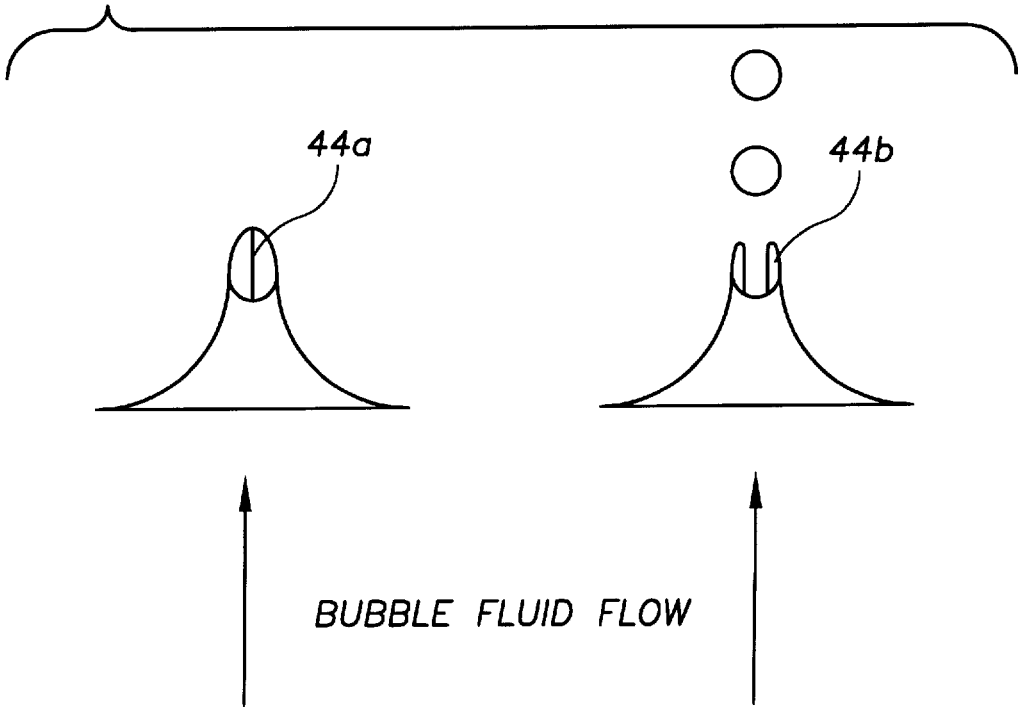
FIG. 5*a* shows the one-way flap valve in open and closed positions.

The preferred valve configuration for this bubble generator 15 is a passive one-way flap-type valve 44, shown in FIG. 5 and in detail in FIG. 5*a*. When at rest, this valve 44 is closed in a rest position 44*a* and does not permit medium fluid 22 to flow into the bubble fluid 21. The valve 44 operates to an open position 44*b* when a higher pressure is experienced on the bubble fluid 21 side and closes when the pressure is decreased below the pressure required to open the valve 44.

Figure 6:
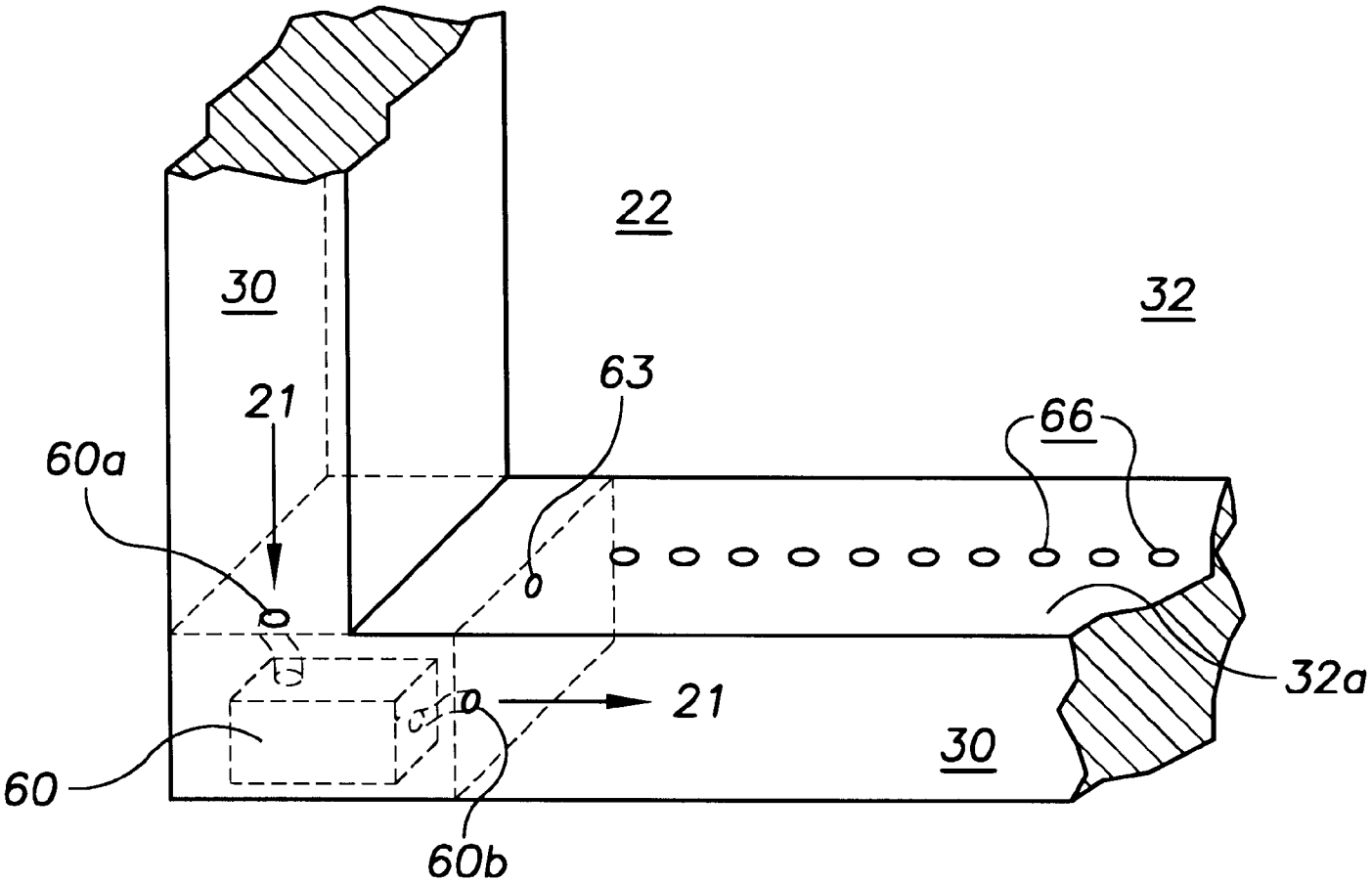
FIG. 6 shows a bubble generation means in the form of a fluid pump separating the bubble fluid into two chambers.
Figure 7:
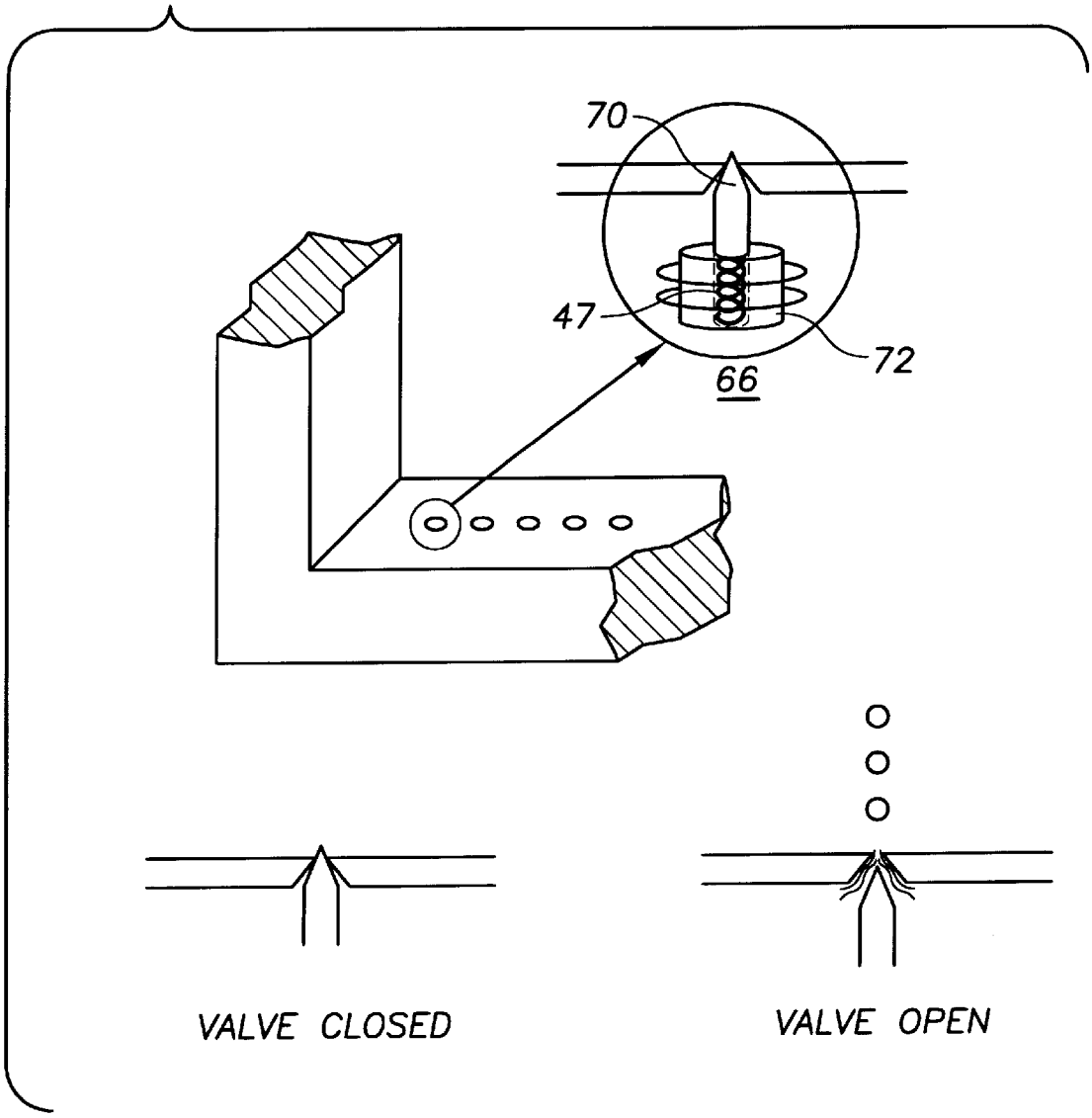
FIG. 7 shows a blow-up of a solenoid-type needle valve that may be utilized by the bubble generation subsystem.

With reference now to FIG. 6 and FIG. 7, a second method of generating bubbles from the bubble generation subsystem 14 uses a fluid pump 60, an over-pressure valve 63 and a plurality of flow control valves 66. The fluid pump 60 is situated proximate to a bottom corner of the BIT product 1 separating the bubble fluid chamber 30 into two chambers. The fluid pump 60 has an inlet 60*a* and an outlet 60*b* each contacting the now two bubble fluid chambers 30, and through which bubble fluid 21 is pumped. The fluid pump 60 and over-pressure valve 63, which can be situated on the fluid pump 60 or just in between the now two chambers, is used to maintain a constant bubble fluid 21 pressure. Each single flow-control valve 66, preferably situated on the bottom 32*a* of the medium fluid chamber 32 depending on the position of each bubble generator, which in this embodiment is the flow-control valves 66 working in conjunction with the fluid pump 60, controls the amount of bubble fluid 21 passing to the medium fluid 22. The timing of each of these flow control valves 66 is controlled by the electronic control subsystem 16. Increasing the fluid pump 60 pressure or flow-control valve 66 open-time creates larger fluid bubbles.

FIG. 7 shows an embodiment of a single flow-control valve 66 of the solenoid type 72 for use with or without the fluid pump 60 (FIG. 6). Although a needle valve 70 is shown having disposed thereunder the spring 47, any device that is capable of controlling the flow of bubble fluid can be used.

Figure 8:
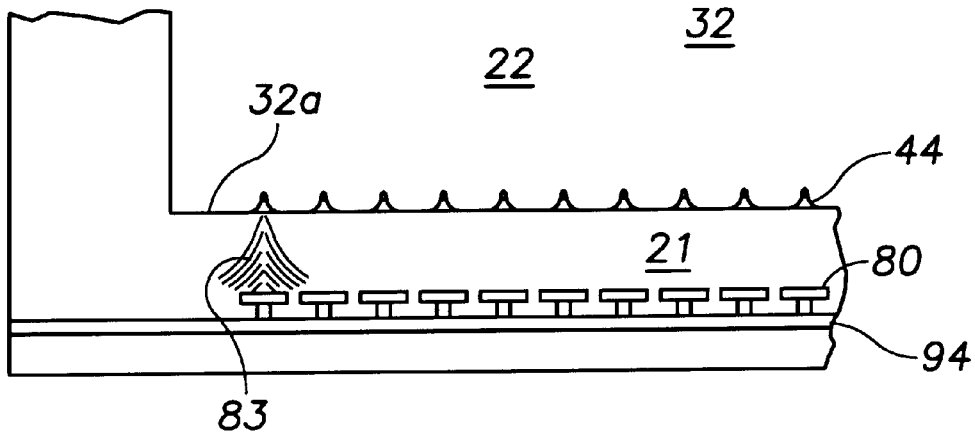
FIG. 8 shows a bubble generation means in the form of a plurality of piezo devices producing a streaming effect.
Figure 8A:
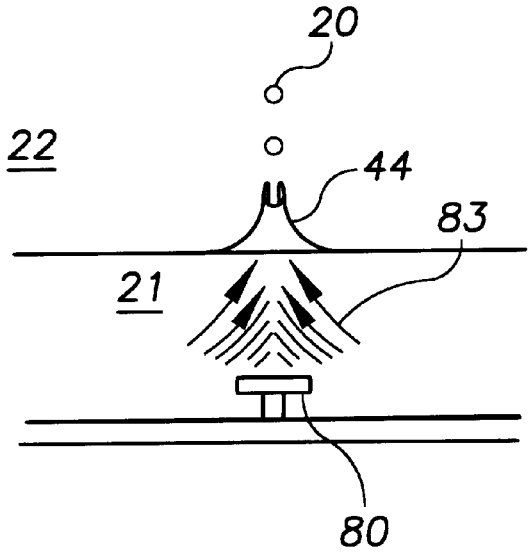
FIG. 8*a* is an enlarged view of the piezo device producing the streaming effect for pushing the bubble fluid through the valve by means of pressure build up.

FIG. 8 shows a third method of bubble generation using a bubble generation subsystem 14 that has no moving parts. This method uses a plurality of piezo devices 80 mounted within the fluid separator and housing subsystem, in this embodiment located below the bottom 32*a* of the medium fluid chamber 32, and a flow-control valve 44 aligned above each piezo device 80. Each piezo device 80 is driven by a periodic radio frequency (RF) signal and is controlled by the electronic control subsystem 16 (FIG. 2) in such a way as to create an effect 83 (within the bubble fluid) known as "streaming". The "streaming" effect 83 causes a higher pressure to be created in a small area of the bubble fluid 21, which is illustrated FIG. 8*a*. This effect relies on focusing the forces exerted by the piezo device 80 to cause fluid "streaming" (or movement within the fluid). The focusing is accomplished by the use of a concave piezo device 80 or an external lens. The concave shape of the piezo device 80 essentially acts as a focusing lens. If a concave piezo device is used, it is located in the bubble fluid 21. A flat piezo device may also be used below the bubble fluid 21 but must have a focusing lens that is built into and part of the housing subsystem 12. The spacing of the piezo device 80 from the valve 44 is determined so that the focused area of fluid streaming effect 83 (higher pressure) is located close to the flow control valve 44.

The use of at least two types of valves is possible. The first uses a passive one-way flap-type valve 44 as described in relation to FIG. 5. When at rest this valve 44 is closed and does not permit medium fluid 22 to flow into the bubble fluid 21 or vice versa. The valve 44 opens when a higher pressure is experienced on the bubble fluid 21 side and closes when the pressure is decreased below the pressure required to open the valve 44. Therefore, when the piezo device 80 is energized, the valve 44 opens and allows bubble fluid 21 to flow into the medium fluid 22. The valve 44 closes when the piezo device 80 is de-energized.

Another possible valve type is shown in relation to FIG. 7. The operation of this needle valve 70 is controlled by the electronic control subsystem 16 and is operated in synchronization with the piezo device 80.

Thus, having described three means of generating bubbles using an electromagnet and plunger, a fluid pump with flow control valves, and a piezo device, it is important to understand the electronic control subsystem 16 responsible for electronic time keeping as well as the control and timing of each bubble generation subsystem 14. This includes controlling the duration of operation of each bubble generator and valve.

Figure 9:
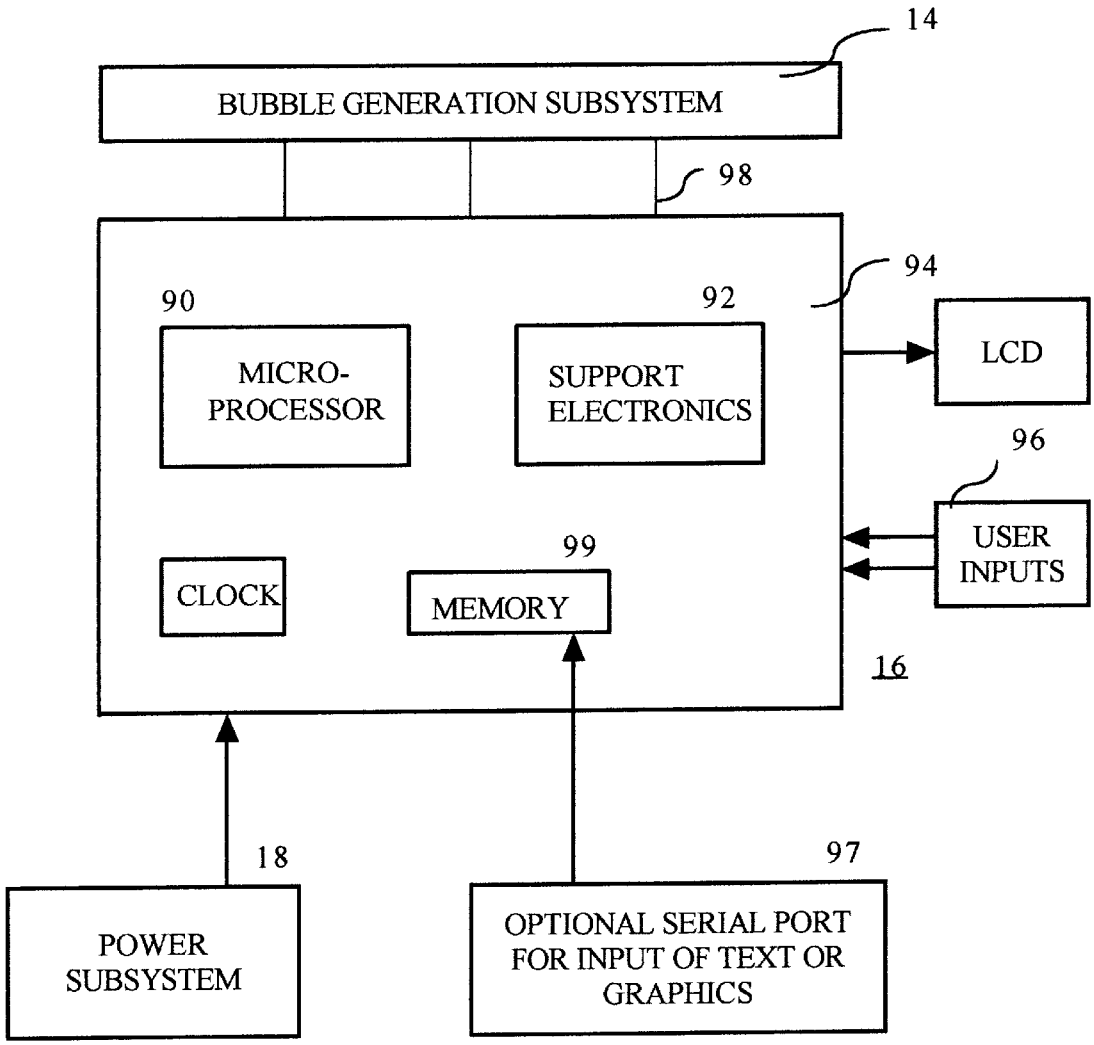
FIG. 9 is a block digram of the implementation of the electronics control subsystem with the bubble generation subsystems and the power subsystems.

With reference then to FIG. 9, the electronic control subsystem 16 is microprocessor 90 based and includes other electronic circuits and support electronics 92 mounted on a printed circuit board (PCB) 94. The PCB 94 attaches to the fluid separator and housing subsystem 12 (FIG. 2). Control outputs are provided for all electrical components (piezos, pump, valves, digital display, etc.) involved in the bubble generation subsystem 14. At least one inputs 96 are provided to the user to set local time and operating features. In the larger BIT products, an input port 97 is provided for input of graphics or text messages. This electronic control subsystem 16 is both software and hardware dependent. Software or hardware is utilized to translate input features, such as graphics or alphanumeric digits, into specific control signals that turn on or off individual bubble generators. This software may be located either in the BIT product or located on an external computer that connects to an input port 97 of the BIT product. In the case of the bubble clock embodiment, the software resides in the product and is implemented into hardware.

The software that processes the text or graphic input 97 outputs a command sequence and stores it within the memory 99 of the BIT product. This command sequence provides information about which bubble generators of the bubble generation subsystem 14 should be energized by way of a plurality of control lines 98 to produce the desired image or text message. The command sequence is made of several command sequence lines and is determined by assembling predetermined digit values stored in lookup tables. Each alphanumeric digit has a stored digit value. Each of these values are assembled in a serial fashion to produce a command sequence line. Each command sequence line controls the creation of one horizontal row of vertical bubbles. Each row of bubbles can and usually does have a different command sequence line. For example, if a digit matrix of five by five bubbles is used to display "12:34 P" (6 digits), then a command sequence would consist of at least six command sequence lines that were generated for each digit and serially assembled. In summary, the electronic control subsystem 16 uses lookup tables to determine which bubble generators are activated, for what duration and in what sequence. The lookup tables can be different for each BIT product and is based on differences in fluid characteristics, number of bubble generators, digit or graphic resolution, size of the display and temperature of operation.

Figure 10:
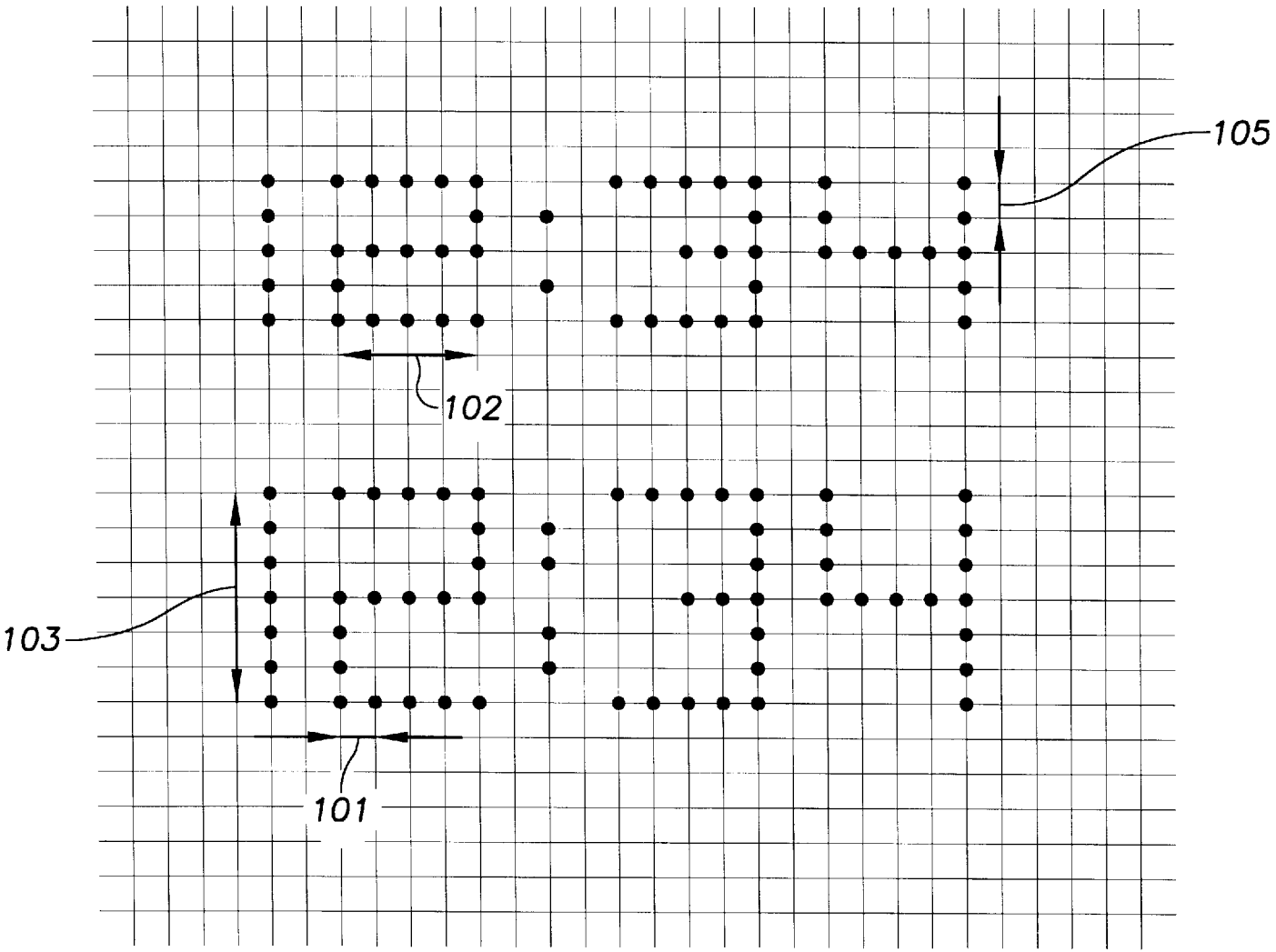
FIG. 10 is a representation of the matrix of bubbles produced by the present method.

The electronic control subsystem 16 determines the timing and duration of each operation and provides the specific control signals to the bubble generators, in particular, the pump, piezos and valves, as appropriate. FIG. 10 shows the creation of the time "12:34".

The first set of control signals is activated to create the first row of fluid bubbles. After each horizontal row of bubbles is created, they start to float towards the top of the surface. The electronic control subsystem 16 determines at what time interval the next horizontal row of bubbles is created. Several horizontal rows of bubbles are created until the full vertical length of an alphanumeric digit or graphic is reached. The process is repeated so that the message or graphic is always visible to the viewer. The timing required to create each row of horizontal bubbles is dependent on the viscosities and densities of the fluids used as well as the complexity of the image or text. A higher resolution image will require a larger number of bubbles to be created and thus the timing between the rows of bubbles will be less. If the fluid bubbles move more slowly through the medium fluid (due to the densities and viscosities of the fluids) then the timing between the creation of rows of fluid bubbles would be increased.

The preferred method for creating an individual digit (such as the "2" in "12:34") is to use five adjacent bubble generators to form a digit matrix. FIG. 10 shows such a matrix of bubbles. It should be understood that each bubble generator can also be situated to form a 2-D grid for display of 3-D images by having the bubble generators situated in rows and columns. The equal spacing 101 between bubble generators determines the width 102 of the digit. The spacing between rows of bubbles 105 is controlled by the electronic control subsystem 16 (FIG. 2), and the number of vertical bubbles generated determines the height 103 of the digit matrix. Using more or less than five bubble generators per digit is possible and will affect the size and resolution of the digit being displayed. For example, using a larger number of bubble generators at the same spacing as the preferred configuration will cause an increase in the size of the digit. However, if in this example a smaller bubble generator spacing 101 is used such that the new number of bubble generators has the same digit width 102 as the preferred configuration, then the digit resolution is increased while maintaining digit size.

With reference now back to FIG. 9, the power subsystem 18 is responsible for providing operating power to the electronic control subsystem 16. The power subsystem 18 receives power input from one of two sources; a DC voltage battery source stored in the BIT product, or an AC voltage source accessed by a power cord.

I claim:

1. A method for producing and controlling an image defined by fluid bubbles in a medium fluid, comprising:

separating a bubble fluid and said medium fluid within a fluids subsystem;

forming said fluid bubbles from said bubble fluid within said medium fluid by utilizing a plurality of bubble generators in a bubble generation subsystem;

maintaining separation of said medium fluid from said bubble fluid by providing a valve disposed above each of said bubble generators; and, controlling and timing a duration of operation of each said bubble generators and each of said valves, further comprising:

mounting electronic circuits and support electronics on a microprocessor-based electronic control subsystem;

providing control inputs to a user to set local time and operating features;

utilizing software or hardware to translate graphics or alphanumeric digits into control signals that activate each of said bubble generators;

assembling a plurality of stored digit values to produce a command sequence line, wherein said command sequence line controls a creation of one horizontal row of said fluid bubbles;

activating a first set of said control signals to create said horizontal row; and, repeating said activation until a full vertical length of said graphic or said alphanumeric digit is reached.

2. The method of claim 1, wherein said bubble generators are situated in a single row to display a 2-D image.

3. The method of claim 1, wherein said bubble generators are situated in rows and columns to form a 2-D grid for display of 3-D images.

4. The method of claim 1, wherein said bubble fluid and said medium fluid differ in viscosity, color, and density.

5. The method of claim 1, wherein said medium fluid is transparent.

6. The method of claim 1, wherein an effect of turbulence within said medium fluid is reduced by increasing a viscosity of said medium fluid.

7. The method of claim 1, wherein a larger of said fluid bubble is maintained in spherical form by increasing a viscosity of said bubble fluid.

8. The method of claim 1, wherein said fluid bubble is enlarged by increasing pressure of said bubble fluid.

9. The method of claim 1, wherein said bubble fluid is a detergent fluid, whereby said fluid bubbles are more resistant to combining after a collision.

10. The method of claim 1, wherein a rate at which said fluid bubbles move through said medium fluid is controlled by varying a fluid density difference between said medium fluid and said bubble fluid.

11. An apparatus for incrementally displaying an image defined by fluid bubbles in a fluid medium, comprising:

a fluid subsystem further comprising at least two fluids, wherein said fluids are a bubble fluid and a medium fluid of greater density relative to said bubble fluid;

a fluid separator and housing subsystem containing therein said fluid subsystem and further comprising:

at least two fluid separation chambers including a bubble fluid chamber containing therein said bubble fluid, and a medium fluid chamber containing therein said medium fluid;

a separation wall having a separation wall top and separating said bubble fluid chamber and said medium fluid chamber and extending from a bottom of said medium fluid chamber up to just below a top of said medium fluid chamber to define an entrance into said bubble fluid chamber, said medium fluid occupying a space up to but not over said separation wall top;

a bubble generation subsystem mounted within said fluid separator and housing subsystem for generating said fluid bubbles and releasing said fluid bubbles into said medium fluid, and further comprising a plurality of bubble generators disposed under said bottom of said medium fluid chamber for generating said fluid bubbles from said bubble fluid, and a plurality of valves vertically aligned with each of said bubble generators separating said fluid chamber and said medium fluid chamber for releasing said fluid bubbles into said medium fluid; and, a microprocessor based electronic control subsystem mounted on said fluid separator and housing subsystem for controlling and timing a release of said fluid bubbles into said medium fluid further comprising:

a printed circuit board attached to said fluid separator and housing subsystem;

a plurality of electronic circuits and support electronics mounted on said printed circuit board;

at least one input device provided to a user to allow said user to set input features;

a software program for translating said input features into specific control signals that incrementally turn on or off said bubble generators; and, a power subsystem for providing operating power to said electronic control subsystem.

12. The apparatus of claim 11, wherein said medium fluid chamber is clear and said bubble fluid chamber is a solid color.

13. The apparatus of claim 11, wherein said input features are graphics.

14. The apparatus of claim 11, wherein said input features are alphanumeric digits.

15. An apparatus for incrementally displaying an image defined by fluid bubbles in a fluid medium, comprising:

a fluid subsystem further comprising at least two fluids, wherein said fluids are a bubble fluid and a medium fluid of different density relative to said bubble fluid;

a fluid separator and housing subsystem containing therein said fluid subsystem;

a plurality of piezo devices mounted within said fluid separator and housing subsystem and driven by a periodic radio frequency signal, said piezo devices adapted to produce a streaming effect within said bubble fluid, whereby a higher pressure is created in a small area of said bubble fluid directly above each of said piezo devices, thereby focusing said bubble fluid in said small area;

a valve separating said bubble fluid and said medium fluid and aligned above each of said piezo devices and spaced from each of said piezo devices so that upon energizing each of said piezo devices, said valve opens and allows said bubble fluid experiencing said higher pressure to flow into said medium fluid;

a microprocessor based electronic control subsystem mounted on said fluid separator and housing subsystem for controlling and timing said piezo devices; and, a power subsystem for providing operating power to said electronic control subsystem.

16. The apparatus of claim 15, wherein said valve is a one-way flap-type valve.

17. The apparatus of claim 15, wherein said valve is a needle valve.

18. The apparatus of claim 15, wherein said piezo device is generally concave and located in said bubble fluid chamber below said medium fluid.

19. The apparatus of claim 15, wherein said piezo device is generally flat and includes a focusing lens.

20. An apparatus for incrementally displaying an image defined by fluid bubbles in a fluid medium, comprising:

a fluid subsystem further comprising at least two fluids, wherein said fluids are a bubble fluid and a medium fluid of different density relative to said bubble fluid;

a fluid separator and housing subsystem containing therein said fluid subsystem and further comprising a bubble fluid chamber and a medium fluid chamber;

a plurality of bubble generators mounted within said bubble fluid chamber, each said bubble generators further comprising:

a mechanical plunger;

an electromagnet attached to said mechanical plunger and adapted to be energized;

a spring disposed in a vertical position below said mechanical plunger; a valve separating said bubble fluid chamber and said medium fluid chamber and mounted above each of said bubble generators, whereby upon being energized, said electromagnet is pulled downward to compress said spring, thereby upon being de-energized, a force of said spring pushes said mechanical plunger upwards, thereby a fluid bubble is created from said bubble fluid and is released from said valve;

a microprocessor based electronic control subsystem mounted on said fluid separator and housing subsystem for energizing said bubble generators; and, a power subsystem for providing operating power to said electronic control subsystem.

21. The apparatus of claim 20, wherein said valve is a needle valve.

22. The apparatus of claim 20, wherein said valve is a passive one-way flap-type valve.

23. An apparatus for incrementally displaying an image defined by fluid bubbles in a fluid medium, comprising:

a fluid subsystem further comprising at least two fluids, wherein said fluids are a bubble fluid and a medium fluid of greater density relative to said bubble fluid;

a fluid separator and housing subsystem containing therein said fluid subsystem and further comprising a bubble fluid chamber and a medium fluid chamber;

a fluid pump situated proximate to a bottom comer of said fluid separator and housing subsystem separating said bubble fluid chamber into two chambers, said fluid pump having an inlet and an outlet contacting said two chambers adapted to have said bubble fluid pumped there through;

an over-pressure valve placed between said two chambers;

a plurality of flow control valves separating said medium fluid chamber and one of said two chambers;

a microprocessor based electronic control subsystem mounted on said fluid separator and housing subsystem for controlling and timing said flow control valves; and, a power subsystem for providing operating power to said electronic control subsystem.

24. The apparatus of claim 23, wherein said flow control valve is a solenoid-type needle valve.

25. The apparatus of claim 23, wherein said flow control valve is a one-way flap type valve.

* * * * *